United States Patent [19]

Babendererde

[11] Patent Number: 4,909,668

[45] Date of Patent: Mar. 20, 1990

[54] MOVABLE SEALING ASSEMBLY FOR TUNNELING MACHINES

[75] Inventor: Siegmund Babendererde, Bad Vilbel, Fed. Rep. of Germany

[73] Assignee: Hochtief Aktiengesellschaft Vorm. Gebr. Helfmann, Essen, Fed. Rep. of Germany

[21] Appl. No.: 129,655

[22] Filed: Dec. 7, 1987

[30] Foreign Application Priority Data

Dec. 16, 1986 [DE] Fed. Rep. of Germany ..... 3642893

[51] Int. Cl.[4] ..... E21D 9/06; E21D 11/10

[52] U.S. Cl. ..... 405/147; 405/146; 277/147

[58] Field of Search ..... 405/146, 150, 1, 147; 277/147, 148

[56] References Cited

U.S. PATENT DOCUMENTS

| | | | |
|---|---|---|---|
| 3,410,098 | 12/1968 | Winberg | 405/147 X |
| 3,561,223 | 2/1971 | Tabor | 405/147 X |
| 3,979,920 | 9/1976 | Burgess et al. . | |
| 4,645,378 | 2/1987 | Hentschel | 405/147 X |

FOREIGN PATENT DOCUMENTS

| | | |
|---|---|---|
| 2620422 | 11/1977 | Fed. Rep. of Germany . |
| 2725827 | 12/1978 | Fed. Rep. of Germany . |
| 3006951 | 9/1981 | Fed. Rep. of Germany . |
| 3015210 | 11/1981 | Fed. Rep. of Germany . |
| 3017057 | 11/1981 | Fed. Rep. of Germany . |
| 3127311 | 2/1983 | Fed. Rep. of Germany . |
| 2560635 | 9/1985 | France . |

*Primary Examiner*—Dennis L. Taylor

*Attorney, Agent, or Firm*—Herbert Dubno; Andrew Wilford

[57] ABSTRACT

The movable tight-sealing ring is positioned between an excavator cover end and a form or casing structure. For a satisfactory movability of the excavator cover end interstice, the tight-sealing sealing ring is supported resiliently by adjustable supporting units freely movable relative to the excavator cover end and the casing or form structure. On one side the tight-sealing sealing ring is provided with a plurality of impressed material feed openings and on the other side with an elastic outer sealing member contactable on the inside of the excavator cover end as well as an elastic inner sealing member pressable against the outside of the form or casing structure.

1 Claim, 3 Drawing Sheets

MOVABLE SEALING ASSEMBLY FOR TUNNELING MACHINES

CROSS REFERENCE TO RELATED APPLICATION

This application is related to the commonly assigned copending application Ser. No. 07/061,864, filed June 11, 1987.

FIELD OF THE INVENTION

My present invention relates to a sealing ring or a joint and, more particularly, to a tight-sealing sealing ring between an excavator cover and a form or casing (liner) of a tunnel gallery or other underground structure.

BACKGROUND OF THE INVENTION

The moving or advance of the excavator cover end interstice at the rear of a form or casing (liner) structure is a step in the operation of an excavating or tunnel building machine which up to now has not been satisfactorily performed in loose earth or ground.

By "excavator cover end interstice" I mean the gap which arises behind the excavator cover end or tail on advancing the excavator cover and which is bounded by the surrounding ground and the casing, form or liner.

The width of the gap is determined by addition of the thickness of the excavator cover end plates, the excavator cover end seal and the free space for mounting of the casing or form protecting the excavator cover end. This gap which has a width of about 10 cm must be fed or moved with the material injected between the tunnel wall and the liner simultaneously with the advance of the excavator cover to prevent the surrounding earth and ground water from being forced into the space. The disadvantageous consequences could include loosening of the ground around the tunnel so that the support of the form is impaired and the layer of earth above the tunnel drops.

To seal the excavator cover end interstice at the front thereof, joint devices have been built which are connected rigidly with the steel plate of the excavator cover outer surface. The loose earth, possibly with ground water, or the injected concrete should be prevented from being forced in the cover by these joint structures. Up to now, injected concrete has been supplied either through holes in the form or casing segments perpendicular to the tunnel axis or through conduits which are positioned in the cover surface parallel to the tunnel axis. This concrete is pressed into the gap.

However, it can not be reliably guaranteed that the advance pressure for the injected concrete will be greater than the pressure which arises from the weight of the earth and ground water. In fact the space which arises behind the cover end on advancing the cover can not always be filled or compensated by the volume of injected concrete.

Small volume differences which arise, for example by the intermittent operation of the piston injection pump, lead to large pressure differences in the fluidized or fluid injected concrete.

This has the result that both ground water and earth are forced in the cover end interstice whereby nonuniform filling and settling are promoted.

Also a combination of several simultaneously connected and operated ducts or conduits for the injected concrete with a gas reservoir to compensate for the intermittent volume increase of the pump surge does not lead to the desired definite constant pressure in the circular gap of the cover end interstice, Constant pressure is not obtained because the small cross section of the ducts or conduits permits a volume flow of the material fed per unit time which is too small relative to the volume increase which arises by the cover advance of the excavator.

OBJECTS OF THE INVENTION

It is an object of my invention to provide an improved tight-sealing sealing ring for the purposes described which will avoid the mentioned drawbacks.

It is also an object of my invention to provide an improved tight-sealing sealing ring which maintains the pressure in the flowing fed in material almost constant at a level which resists the pressure from the weight of the surrounding earth and ground water.

SUMMARY OF THE INVENTION

These objects and others which will become more readily apparent hereinafter are attained in accordance with my invention in a tight-sealing sealing ring between an excavator cover end and a casing or form (liner) structure.

According to my invention the tight-sealing sealing ring is braced resiliently by a plurality of adjustable supporting units freely movable relative to the excavator cover end and the casing or the form structure in the digging direction and is provided on one side with a plurality of material advance openings and on the other side with an elastic outer sealing member contactable on the inside of the excavator cover end as well as an elastic inner sealing member pressable against the outside of the form or casing structure.

Also according to my invention the interstice sealing ring is no longer rigidly attached with the cover outer surface or mantel but is positioned so as to be movable in the longitudinal direction of the cover. Thus it is supported resiliently with a variable spring constant.

Control and regulating members are provided so that the joint structure can move only so it is parallel to the plane which is perpendicular to the cover axis.

Also spacing or distancing (limit) contacts switches can define the longitudinal displacement toward and away from the shield of the interstice sealing ring.

These contacts or switches can give an impulse or momentum which controls the advance direction depending on ring motion.

The circumferential sealing ring is pressed with the help of an elastic rubber or compressible element against the inside of the cover end region and the outside of the tunnel pipe of the form or casing.

Thus on the one hand a pressure tight boundary for the impressed mass of hardenable elastic material pressed through the opening in the seal is attained.

Also an equalization of the occasional unavoidable eccentricity between the cover and the tunnel pipe axis which uncouples the seal freely movable in the tunnel excavating direction is attained.

By the motion of the excavator cover, of the casing or form structure and the continuous movement of the circular space through several openings distributed about the circumference of the sealing ring injected hardenable matter is continuously fed into the circular space. The pressure produced acts to continuously and immediately compress the injected mass between the surrounding earth, the casing or form pipe and the sealing ring. Thus the principal aim of my invention, namely forcing a tunnel assembled from a liner through surrounding earth with minimal settling is attained. Hence, a particularly rapid hardening of the impressed mass does not occur. Further the impressed concrete, which is usually only of small to moderate hardness, is pumpable longer. The danger of clogging the conduits or ducts because of early solidification is reduced.

The clogging of the conduits or ducts with concrete on interruption of the impressing process is prevented in the vicinity of the sealing ring in which for example replaceable packing is installed in corresponding advance-through openings of the sealing ring.

The forward motion of the freely moving sealing ring is completely decoupled from the motion of the cover while maintaining the pressure in the injected mass by pumping it in through pump pipes. Pressure stable supporting units, e.g. pneumatic cylinders, are used to control the sealing ring during the excavation operation in the digging direction.

Several specific forms of my invention are possible. Specifically the supporting unit can advantageously be a piston-and-cylinder device. Moreover in practice it has proved especially appropriate when the outer sealing member is made of a radially adjustable rubber or plastic ring while the inner sealing member is constructed as a trailing leaf-spring seal.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
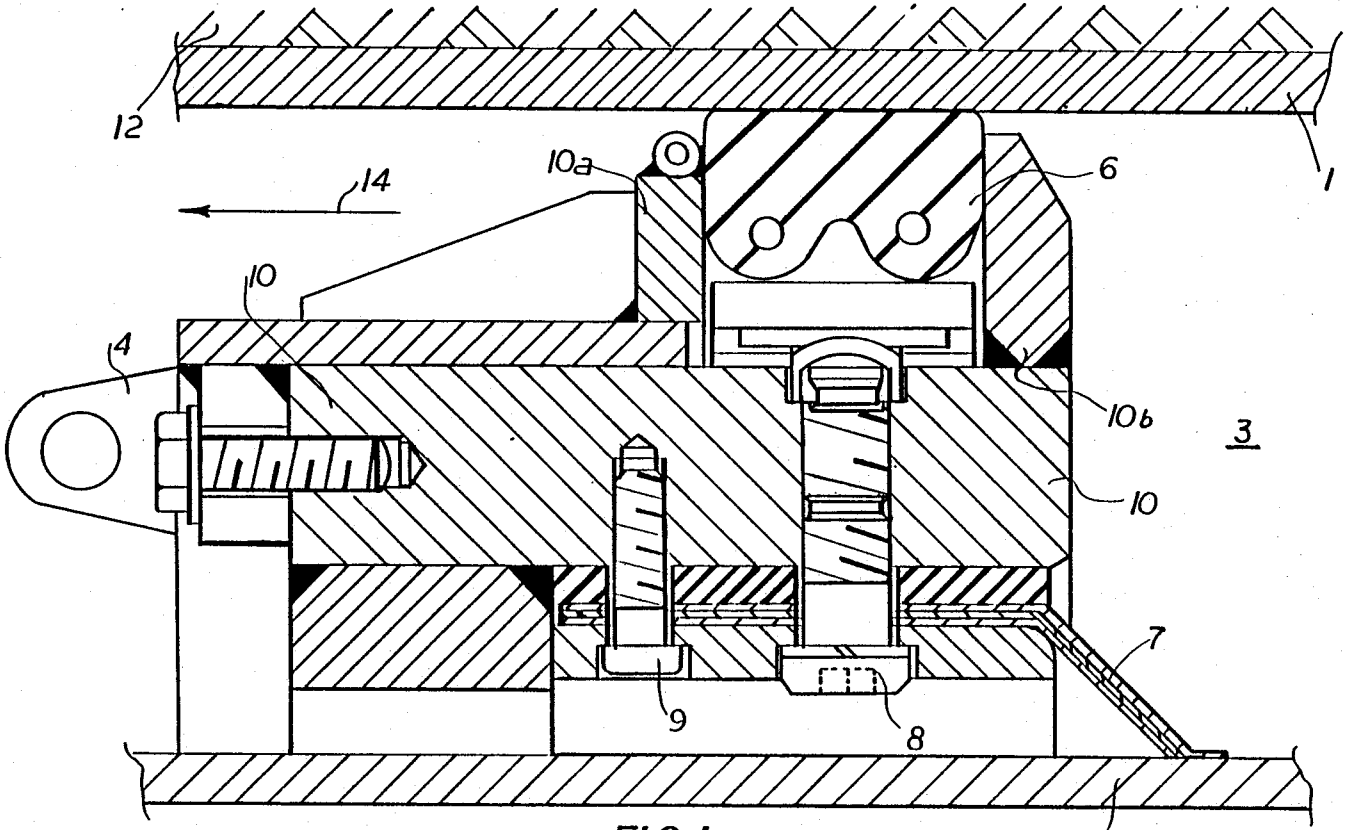
FIG. 1 is a cross sectional view through a sealing ring assembly according to my invention.

The tight-sealing sealing ring assembly shown in the drawing is positioned between the rear portion of an excavator cover end 1 and the front end of a form or casing structure 2 and acts to seal the excavator cover end interstice 3 from a material which is injected, e.g. concrete, as a step in the pouring of a lining for the underground structure.

Figure 3:
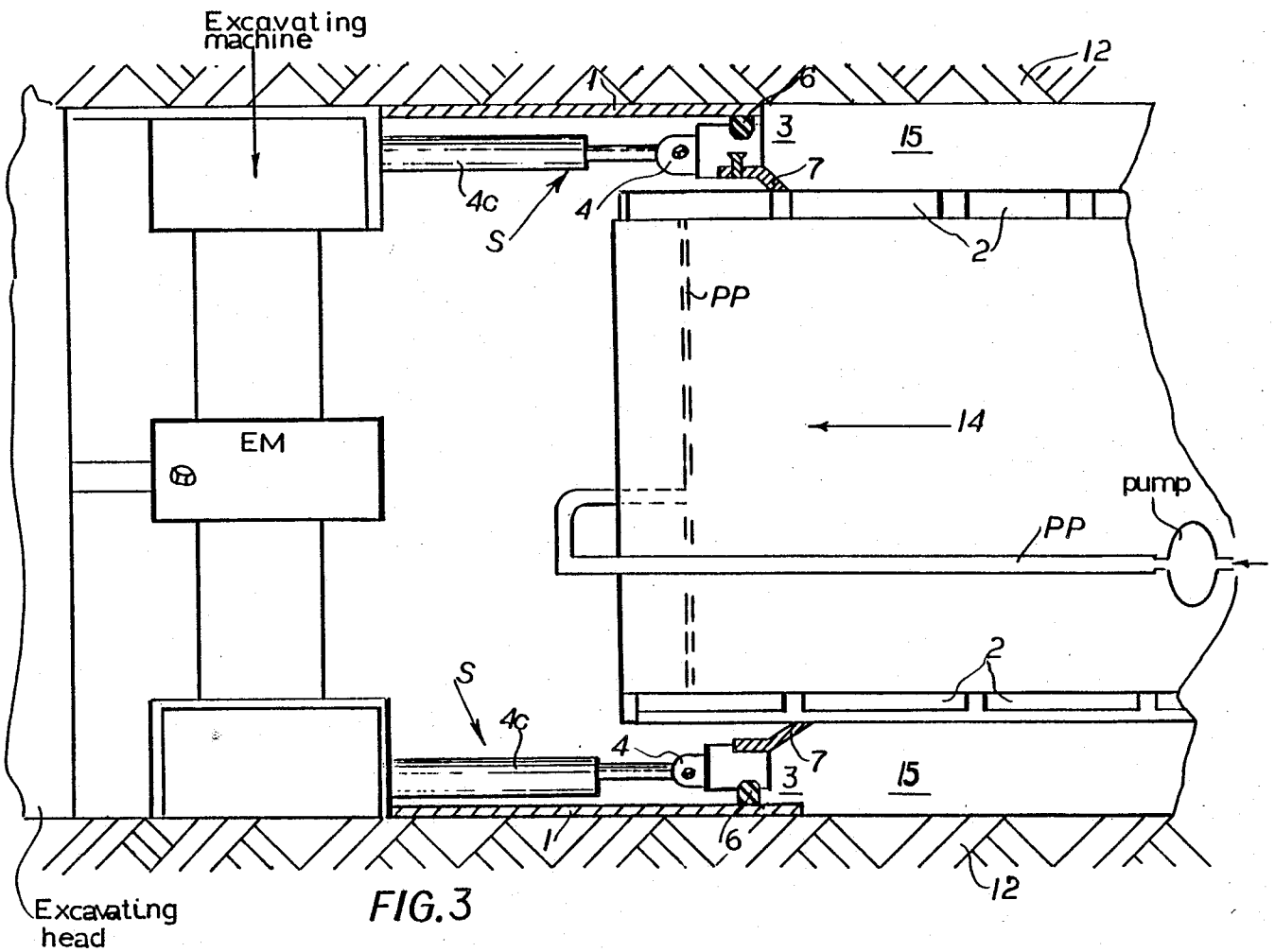
FIG. 3 is a more complete but highly diagrammatic axial cross sectional view through a cover end of an excavating machine and a form or casing showing the supporting units for the movable tight-sealing sealing ring of my invention.

The tight-sealing sealing ring is supported resiliently freely or easily movable relative to the excavator cover end 1 and the form or casing structure 2 in the digging direction by adjustable supporting units s which can be piston-and-cylinder devices 4*c* as shown in FIG. 3.

One of several mounting eyes 4 in which a supporting unit s is attached is shown in FIGS. 1 and 3.

Figure 2:
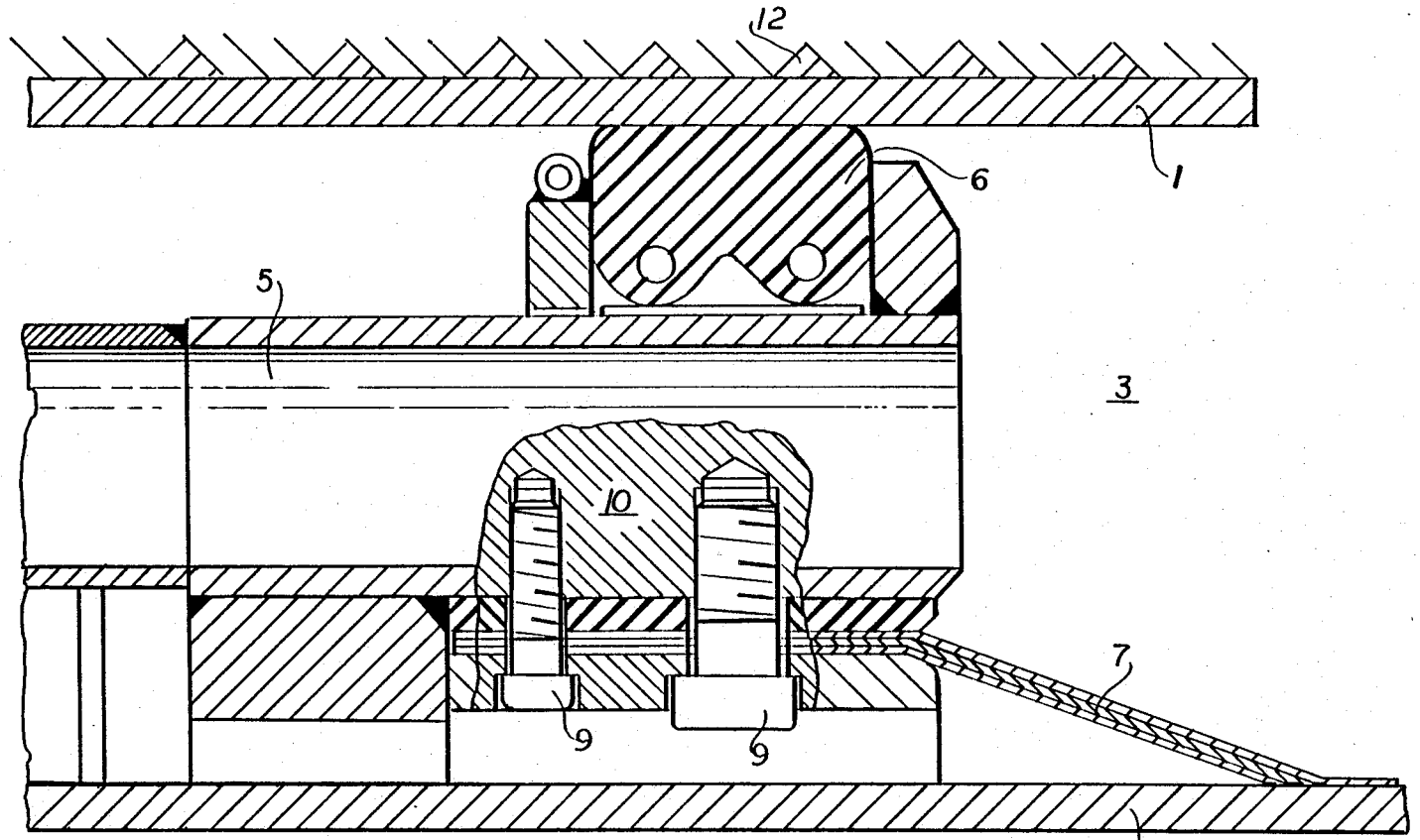
FIG. 2 is a cross sectional view similar to FIG. 1 through the sealing ring assembly of FIG. 1 but at another angular position.

Several material advance openings 5 for concrete to be injected between the surrounding earth 12 and the casing or form 2 are distributed uniformly over the circumference on the front side of the tight-sealing sealing ring (see FIG. 2).

Moreover the tight-sealing sealing ring has an elastic outer sealing member 6 and an elastic inner sealing member 7.

The elastic outer sealing member 6 comprises a rubber or plastic ring which is contactable on the inside of the excavator cover end 1.

Furthermore, suitable radial mounting screws 8 are provided for the radial adjustment of the outer sealing member 6. The screws 8 are angularly equispaced about the axis of the assembly.

The inner sealing member 7 pressable against the outside of the casing or lining structure 2 comprises a trailing leaf spring seal which is attached by radial screws 9 in the sealing ring assembly.

The tight-sealing sealing ring of my invention has a central ring body 10 to which the inner sealing member 7 (the trailing leaf spring seal) is attached by the radial screws 9 and on which the elastic outer sealing member 6 is mounted between radial flanges 10*a*, 10*b* and urged outward by mounting screws 8. The advance openings 5 naturally are provided in this central ring body 10.

The digging or advance direction of the excavator machine is indicated by the arrow 14.

The use of the tight-sealing sealing ring according to my invention with an excavating machine EM which is digging a tunnel is shown in FIG. 3.

A concrete lining 15 is being constructed behind the advancing excavating machine EM using a form 2. The tight-sealing sealing ring is supported on the excavating machine EM by supporting units s which comprise the piston-and-cylinder devices 4*c*. These are distributed circumferentially. Also as shown in FIG. 2 material advance openings 5 are distributed circumferentially and fed with fluid concrete by pump P through pump pipes PP. The pistons of the piston cylinder devices 4*c* are pivotally connected with the eyes 4 of the sealing ring.

I claim:

1. A tight sealing-ring assembly between an excavator cover end and a casing structure, the sealing-ring assembly comprising:

a single central ring body of said tight-sealing sealing ring with a plurality of angularly spaced and rearwardly opening material advance openings, whereby concrete can be injected through the opening into the space rearward of the ring between the cover end and the casing structure;

an elastic outer sealing member which is a radially adjustable rubber or plastic ring;

means for pressing the elastic outer sealing member radially outward against the inside of said excavator cover end on said central ring body;

an elastic inner sealing member which is a trailing leaf spring seal attached to said central ring body and pressing radially inward against the outside of said casing structure; and a plurality of adjustable piston cylinder devices braced resiliently between the ring and the cover end, whereby the ring is freely movable relative to said excavator cover end and said casing structure in a digging direction.

* * * * *